United States Patent [19]

Carmody

[11] Patent Number: 4,949,924

[45] Date of Patent: Aug. 21, 1990

[54] SUPPORT FIXTURE FOR MOUNTING ON RAILINGS AND THE LIKE

[76] Inventor: Burr T. Carmody, 955 S. Wellington Ct., Park Ridge, Ill. 54457-9040

[21] Appl. No.: 59,340

[22] Filed: Jun. 8, 1987

[51] Int. Cl.[5] ..... A47B 96/00

[52] U.S. Cl. ..... 248/215; 248/241

[58] Field of Search ..... 248/214, 215, 241, 297.3, 248/260, 235, 244, 201, 287, 288, 298, 295.1; 211/175, 108, 88

[56] References Cited

U.S. PATENT DOCUMENTS

| | | | |
|---|---|---|---|
| 957,324 | 5/1910 | Gall | 248/214 X |
| 2,809,002 | 10/1957 | Rudolph | 248/298 X |
| 2,984,440 | 5/1961 | Simons | 248/295.1 X |
| 3,185,422 | 5/1965 | Spindler | 248/287 X |
| 4,138,019 | 2/1979 | Smith | 248/214 X |
| 4,140,294 | 2/1979 | Zwarts | 248/287 X |
| 4,179,091 | 12/1979 | Bidney | 248/295.1 X |
| 4,662,629 | 5/1987 | Plovie | 248/214 X |

*Primary Examiner*—Ramon O. Ramirez
*Attorney, Agent, or Firm*—Robert J. Black

[57] ABSTRACT

A fixture adapted for mounting on railings and the like consisting of a pair of mounting brackets, each formed in a generally L-shaped configuration with horizontal and vertical legs. A horizontal projection on the vertical leg which includes a downward-facing vertical lip is adapted to be placed over and from the rear of the railing or similar structure. The horizontal leg also includes at its forward end a vertical lip which facilitates in retaining a horizontally disposed shelf or flower box in position on the support. Adjustment means are also included in both the horizontal and vertical legs to facilitate adaptation of the present support to a number of different environments and to a number of different-sized horizontally disposed objects.

12 Claims, 2 Drawing Sheets

SUPPORT FIXTURE FOR MOUNTING ON RAILINGS AND THE LIKE

BACKGROUND OF THE INVENTION

1. Field of the Invention

The present invention relates to the field of support fixtures and more particularly, to such fixtures adapted for mounting onto a railing or the like.

2. Discussion of the Background art

Plants and flowers, particularly those mounted in flower boxes or flower pots, are always popular, particularly with condominium, apartment or townhouse dwellers, who frequently have no yard for plants to be placed in. However, even may individuals having yards or similar facilities increasingly make use of potted plants or flower boxes for decorative purposes.

Numerous types of hangers are available for hanging potted plants from overhead beams, rafters and so forth. In addition, shelves mounted to windowsills or walls by various types of shelf brackets are available for supporting potted plants or flower boxes. Such shelf brackets have been disclosed by both Bartlet and Rogers (U.S. Pat. Nos. 1,224,127 and 1,914,617, respectively). Generally, such shelf brackets are adjustable to the extent the shelf may be leveled when the brackets are mounted on different types of supporting structures. Such brackets are available for use in mounting such units as shelves or flower boxes to support structures. However, many are not applicable for use in mounting on wrought-iron railings and the like.

A number of disabvantages are of course associated with these types of support brackets which are designed principally for being detachable mounted on windowsills or on horizontal wall boards. Such brackets are, for example, not adapted for being mounted on or attached to wrought-iron railing as previously noted. These railings are those commonly found on balconies and aroung porches or patios where it is frequently desirable to have flower boxes or potted plats. For such railing use, the shelf brackets must not only be adjustable to enable leveling of a shelf or a flower box installed on the brackets according to different sizes and shapes of railing supports, but also provide means for securing the brackets to different sizes of railings so the brackets are not easily dislodged.

Furthermore, brackets of the types disclosed by Bartlet and Rogers receive the shelves at the top of the bracket to be level with, for example, a windowsill to which the brackets are mounted. As a result, flower boxes or potted plants or similar articles placed on the shelves could easily be knocked off the shelves, or the entire flower box itself could be dislodged. This is generally considered totally unsatisfactory for shelves or flower boxes mounted on railings, particularly on balconies from which the plants or articles might fall onto individuals or property below. There is, therefore, a need for an improved type of bracket arrangement or support fixture for mounting on railings and the like.

SUMMARY OF THE INVENTION

A support fixture for mounting onto railings or the like as set forth in the present invention comprises a pair of generally L-shaped brackets, each including a vertical section having at the end thereof a forward projecting horizontal section to fit over the top of the railing with a downward-faced lip acting to prevent the railing engaging portion from sliding off of the top railing. The horizontal section on which the flower box or shelf is mounted has at the outward end thereof a small verticla projecting portion which acts to prevent the flower box or shelf from being easily pushed off the horizontal portion of the supports. Joining the two brackets is a horizontal bar or stabilizing means which, when the entire support fixture is placed on the railing by first placing the two bracket vertical portions through the vertical portions of the railing and then placing the uppermost forward projecting horizontal portions up and over the top of the railing and then allowing the entire assembly to move in a downward position so that the stabilizing bar presses against one or more of the railing verticals, effectively provides a locking arrangement. The bracket is thus stabilized and retained in position on the railing. Placement of a shelf or flower box on the horizontal portion provides additional weight further forcing the stabilizing bar against the vertical members of the railings and thus, further securing the entire support fixture against and onto the railing, providing a secure and stable mounting for the flower box or shelf placed thereon. It is also envisioned by use of various configurations of materials that the support brackets may be made adjustable in both the horizontal and vertical direction and likewise, the stabilizing bar can also be made adjustable to determine the spacing between the two or more brackets employed in the support fixture of the present invention.

Of course, it is quite possible to make the bracket portions of the support fixtures of solid one-piece construction as it is also possible to make the stabilizing means or horizontal joining bar a single metallic piece with the dimensions of all portions designed to fit a particular railing on which the support fixture is to be employed. In the present arrangement, crown bolts, lock washers and wing nuts are used to join the various adjustable portions of the horizontal and vertical sections of the support brackets, while the stabilizing fixture may be joined on a friction-fit fit basis or a small set screw can be employed to lock one section in fixed position within the other.

BRIEF DESCRIPTION OF THE DRAWINGS

A better understanding of the present invention may be had from a consideration of the following detailed description taken in conjunction with the accompanying drawings in which.

DESCRIPTION OF THE PREFERRED EMBODIMENT

Figure 1:
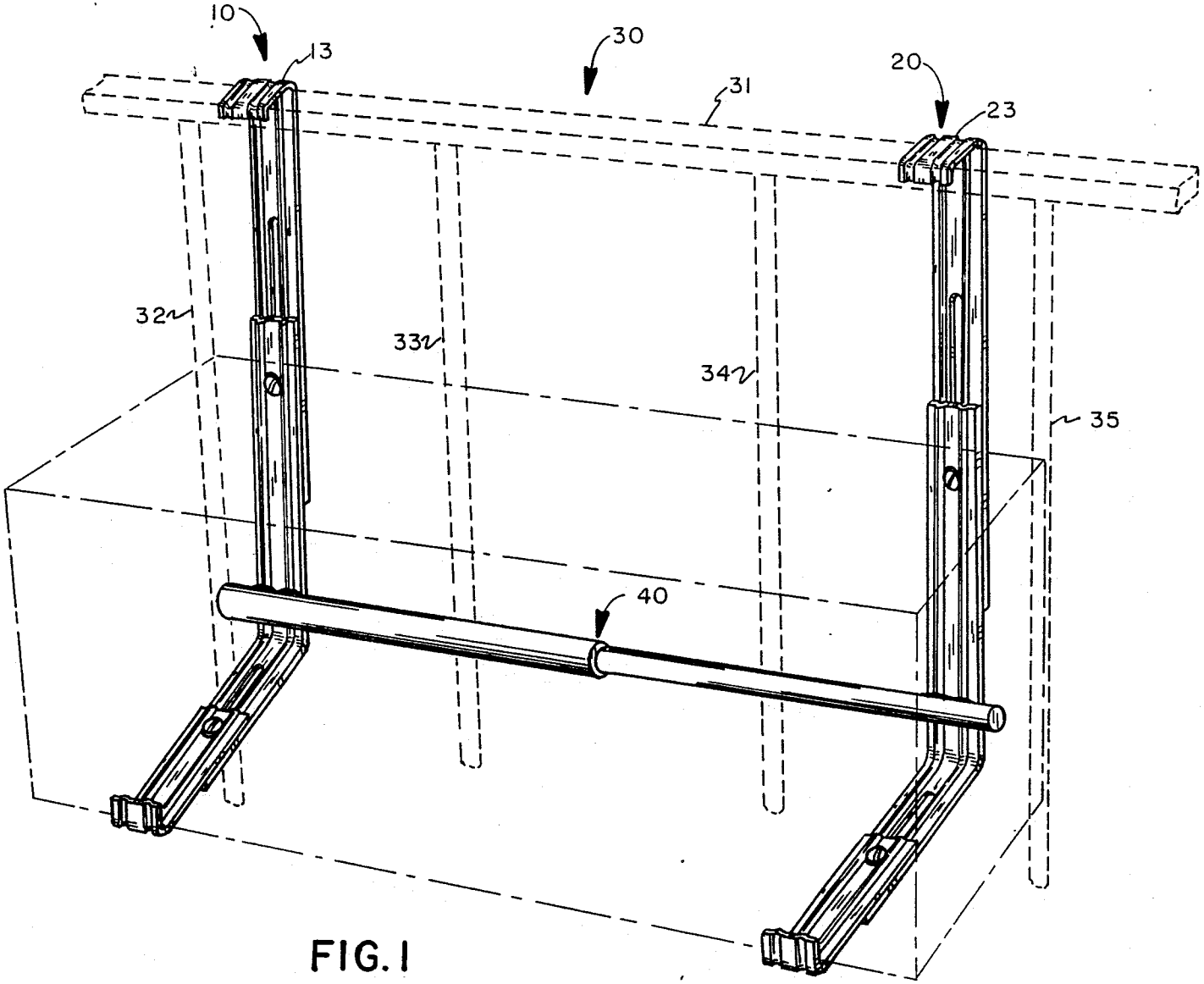
FIG. 1 is a perspective view of a support fixture showing the fixture mounted on a railing.

Referring now to FIG. 1, a support fixture particularly adapted for mounting on railing and the like comprises generally a pair of mounting brackets 10 and 20 and an associated stabilizing means 40.

Each of the mounting brackets is essentially identical and the following description will generally be applicable to both mounting brackets 10 and 20, except for the indicia included in the description thereof. As seen first in FIG. 1, a mounting bracket, such as 10, is essentially L-shaped having on the vertical leg thereof at its upper end a horizontal projection with a downward-turning lip. The horizontal projection 13 is intended to fit over the top rail of the railing 31 with the downward-turned lip acting to prevent sliding off of the bracket from the rail 31. It should be noted that the bracket 10 in being placed over the top rail 31 is brought into position from the rear as one faces the railing.

The horizontal portion of each bracket terminates at its forward end in a vertical section 14 which, with the horizontal portion acting to support a flower box such as that shown in phantom in FIG. 1, or a shelf which could also be placed on the horizontal portion.

As may be further seen by reference to FIG. 1, a second bracket 20 virtually identical to that of bracket 10 is also placed on railing 31 with the horizontal portion 23 engaging the top portion of the railing. Like bracket 10, bracket 20 is also placed onto the railing 31 from the rear as one faces the railing. A very important portion of the present invention is the stabilizer bar 40 which is fastened by welding or other means to both brackets 10 and 20. After both brackets are placed over railing 31, the stabilizer bar 40 which is joined to both brackets is in front of vertical members 33 and 34 of the railing. As may be readily seen from the foregoing, when a shelf or flower box are placed on the horizontal portions of brackets 10 and 20, the weight thereof causes a downward force on the brackets forcing the stabilizing bar 40 against the front side of the vertical members 33 and 34 while the brackets 10 and 20 are affixed over the top to stabilize the entire support fixture arrangement. Thus, when a shelf or flower box (like that shown in phantom in FIG. 1) is placed on the horizontal portion of the brackets 10 and 20, the downward force of the flower box or shelf and the weight associated therewith further acts to stabilize the entire assembly.

Figure 2:
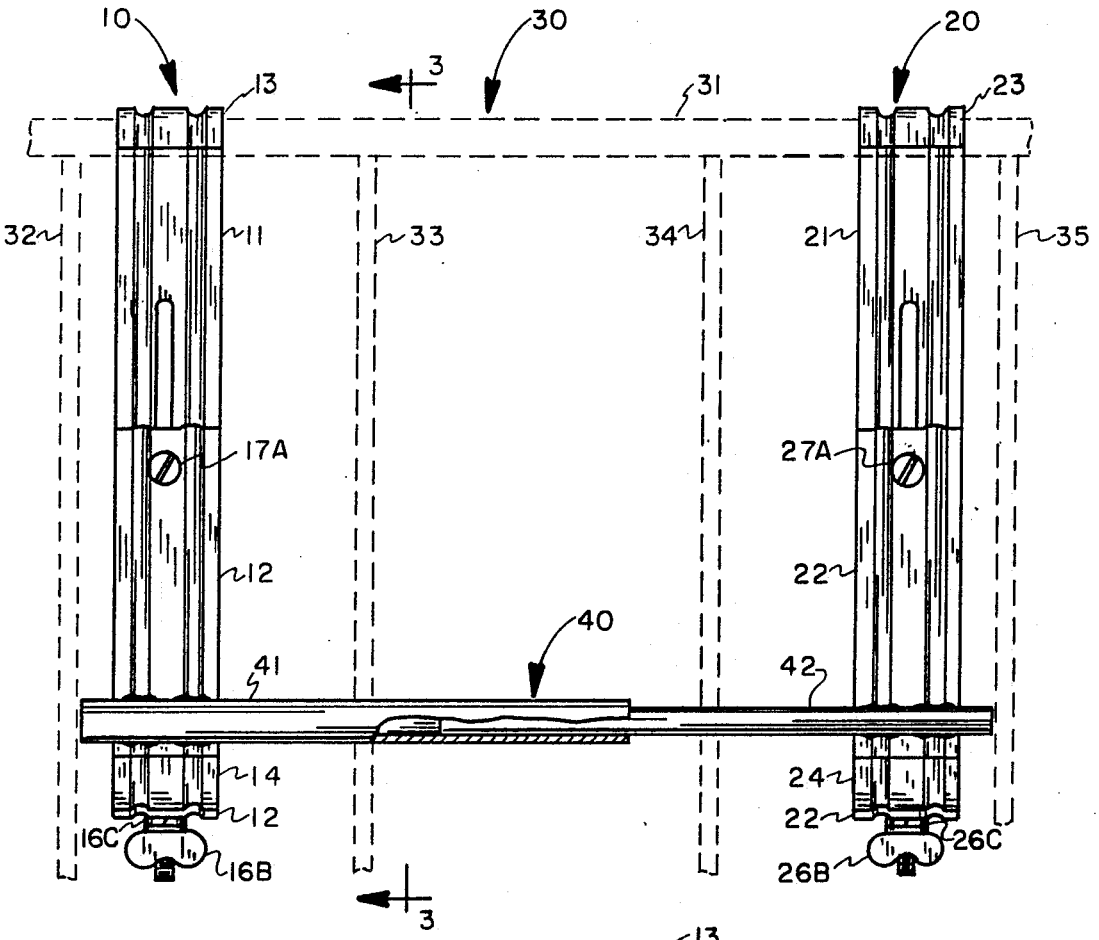
FIG. 2 is a front elevational view of the support fixture of the present invention mounted on a railing.
Figure 3:
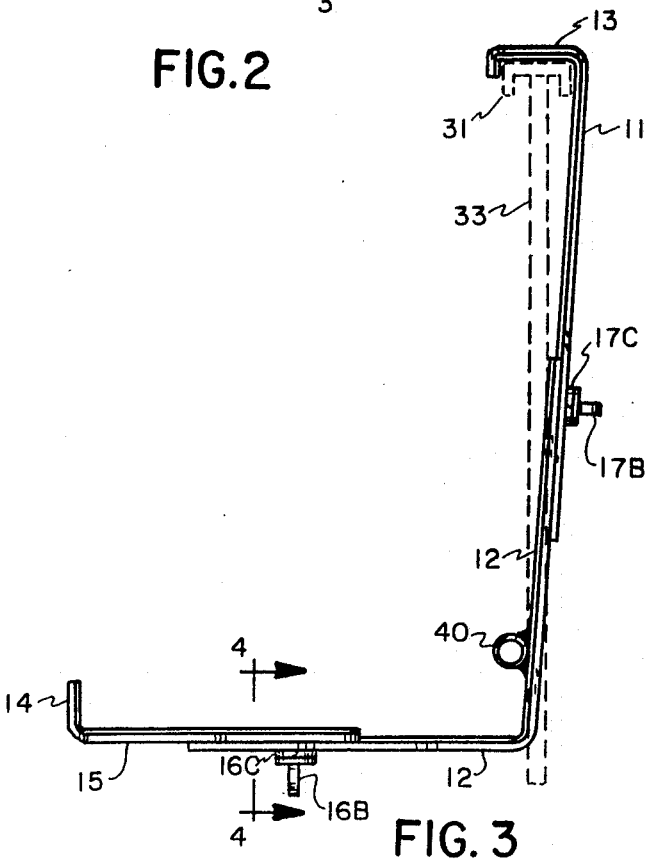
FIG. 3 is a side elevational view of one of the brackets of the support fixture of the present invention, shown in position on a railing.

Referring now to FIG. 2 and to FIG. 3, the details of the adjustable portions of the support fixture of the present invention are shown. As may be seen by reference to FIGS. 2 and 3, each of the brackets (and the bracket 10 will be used by way of example) consists of an L-shaped base portion 12 to which are adjustably fastened a vertical section 11 and a horizontal section 15. Both the L-shaped section 12, vertical section 11 and horizontal section 15 are all formed with a type of channel iron which facilitates their placement against each other on an interlocking basis. The vertical portion 11 as well as the horizontal portion 15 are each equipped with a large slot.

Figure 4:
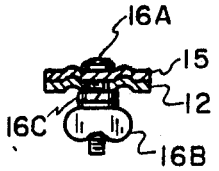
FIG. 4 is a sectional view taken along lines 4—4 of FIG. 3 and shows the detail of the fastening arrangement for joining the adjustable portions of the brackets employed in the support fixture of the present invention.

As may be seen by referring to FIG. 2, the upper vertical section 11 contains an elongated slot therein as does the horizontal section 15 (slot not shown) and the L-shaped portion 12 contains a hole in each of the legs thereof to facilitate the placement of a fastening means such as that shown in FIG. 4 consisting of a crown bolt 16A, a lock washer 16C and a wing nut 16B. Thus, the vertical portion 11 can be raised up or downward over a two-or-more-inch adjustment dimension while the horizontal section 15 can likewise be slid forward or backward for a similar dimension. In this manner, the height of the flower box or shelf dimension from the top rail 31 can be adjusted as can the depth of the support bracket on which the shelf or flower box is placed. This adjustment provides a relatively snug fit to inhibit the dislocation or movement of any shelf or flower box placed on the support fixture.

The stabilizer bar 40 can also be made adjustable by consisting of a tubular portion 41 into which a solid or rod portion or other tubular portion 42 can be inserted with enough distance of overlap between the two being included to facilitate horizontal adjustment of the bracket to accommodate a number of different placements over the vertical members of the rail and assure that the stabilizer bar is able to engage or press against one or more vertical members of the railing on which the support fixture of the present invention is to be mounted.

As noted previously, the requirement for adjusting means in both the brackets and the stabilizer bar is not necessary and the invention could be embodied in customdesigned units intended for a use or applications with particular railings and particular shelves or flower boxes.

While not shown in the drawings, it can also be envisioned that other arrangements, such as a number of circular hoops, could be affixed in a horizontal plane to the stabilizer bar in such a way that flower pots could be inserted therein or similar units. It will also be obvious to those skilled in the art that numerous other modifications may be made without departing from the spirit and scope of the present invention which shall be limited only by the scope of the claims appended hereto.

What is claimed is:

1. A support fixture for mounting onto railings or the like, said fixture comprising:

a plurality of brackets, each adapted to be mounted on a different side of at least one member supporting the railing on which said fixture is mounted, each of said brackets including, a horizontal section adapted to support a horizontally disposed object;

a vertical section joined to said horizontal section, including a forward projecting horizontal portion adapted to be brought into position from the rear, then to be placed over said railing; and stabilizer means connecing said brackets, adapted to be placed in front of at least one of said railing support members.

2. A support fixture for mounting onto railings or the like, as claimed in cliam 1, wherein:

said horizontal section further includes a vertical portion extending in an upward direction on the forward end of said horizontal section, adapted to assist in retention of said horizontally disposed object.

3. A support fixture for mounting onto railings and the like, as claimed in claim 1 wherein:

said vertical section further includes a downward-facing lip on the forward portion of said horizontal portion, adapted to assit in the retention of said horizontal portion on said railing.

4. A support fixture for mounting onto railings or the like, as claimed in claim 1, wherein:

said vertical section includes means for adjusting the length of said vertical section.

5. A support fixture for mounting onto railings or the like, as claimed in claim 4, wherein:

said adjustment means comprise said vertical section including first and second vertical portions, each inlcuding at least one opening therein and fastening means adapted to join said first and second sections on an adjustable basis.

6. A support fixture for mounting onto railings or the like, as claimed in claim 1, wherein:

a horizontal section further includes adjustment means adapted to facilitate adjustment of the length of said horizontal section.

7. A support fixture for mounting onto railings or the like, as claimed in claim 6, wherein:

said adjustment means comprise said horizontal section including first and second horizontal portions, each including an opening therein and fastening means adapted to join said first and second sections on an adjustable basis.

8. A support fixture for mounting onto railings or the like, as claimed in claim 1, wherein:

said stabilizer means further includes adjustment means to facilitate the determination of the length of said stabilizer means.

9. A support fixture for mounting onto railings or the like, as claimed in claim 8, wherein:

said stabilizer adjustment means comprise a first hollow tube section and a rod or, in the alternative, a second hollow tube, adapted to be placed within said first hollow tube, whereby the length of said stabilizer bar may be increased or decreased.

10. A support fixture for mounting onto railings or the like, as claimed in claim 1, wherein:

each of said brackets and said stabilizer means are each of one-piece construction.

11. A support fixture for mounting onto railings or the like, as claimed in claim 1, wherein:

said brackets and said stabilizer bar are all adapted to be adjusted dimensionally.

12. A support fixture for mounting onto railings or the like, said fixture comprising:

first and second brackets, each adapted to be mounted on a different side of at least one member supporting the railing on which said fixture is mounted, each of said brackets including, an adjustable horizontal section, adapted to support a horizontally disposed object and having a vertical portion extending upward on a forward end of said horizontal section, adapted to assist in retaining said horizontally dispersed object in position;

an adjustable vertical section joined to said horizontal section including a forward-projecting horizontal portion at the upper end of said vertical section, adapted to be placed over said railing and further including on said horizontal section a downward-projecting lip, adapted to facilitate retention of said horizontal position over said railing; and adjustable stabilizer means connecting said vertical sections of said first and second brackets, adapted to be placed in front of at least one of said railing support members.

* * * * *